US009167920B2

(12) United States Patent
Grama et al.

(10) Patent No.: US 9,167,920 B2
(45) Date of Patent: Oct. 27, 2015

(54) WRAP AROUND BED SKIRT

(71) Applicant: Levinsohn Textile Co., Inc., New York, NY (US)

(72) Inventors: Risa E. Grama, Merrick, NY (US); Adam L. Levinsohn, Morris Township, NJ (US)

(73) Assignee: Levinsohn Textile Co., Inc., New York, NY (US)

( * ) Notice: Subject to any disclaimer, the term of this patent is extended or adjusted under 35 U.S.C. 154(b) by 0 days.

(21) Appl. No.: 14/109,150

(22) Filed: Dec. 17, 2013

(65) Prior Publication Data

US 2014/0298585 A1 Oct. 9, 2014

Related U.S. Application Data

(60) Provisional application No. 61/807,988, filed on Apr. 3, 2013.

(51) Int. Cl.
*A47G 9/02* (2006.01)

(52) U.S. Cl.
CPC ..... *A47G 9/0292* (2013.01)

(58) Field of Classification Search
CPC ..... A47G 9/0292; A47G 9/02; A47G 9/0246; A47G 9/0284; A47G 9/04; A47C 21/022; A47C 21/028
USPC ..... 5/493, 495–497, 482, 499
See application file for complete search history.

(56) References Cited

U.S. PATENT DOCUMENTS

| | | | | |
|---|---|---|---|---|
| 2,245,779 | A | 6/1941 | Edwards | |
| 3,144,666 | A * | 8/1964 | Ragsdale Mazera et al. | 5/493 |
| 3,368,601 | A * | 2/1968 | Gantert-Merz | 108/90 |
| 3,739,408 | A * | 6/1973 | Pagels | 5/496 |
| 3,999,233 | A | 12/1976 | Morris | |
| 4,141,097 | A | 2/1979 | Levinsohn | |
| 4,807,316 | A * | 2/1989 | Whipple | 5/493 |
| 5,271,112 | A * | 12/1993 | Bible et al. | 5/493 |
| 5,621,931 | A * | 4/1997 | Hamilton | 5/493 |
| 5,715,553 | A | 2/1998 | Baron | |
| 5,749,110 | A | 5/1998 | Gamble | |
| 5,802,637 | A | 9/1998 | Bordo | |
| D409,873 | S | 5/1999 | Johnson | |
| 5,966,758 | A * | 10/1999 | Karam | 5/493 |
| 6,035,469 | A | 3/2000 | Schrougham | |
| 6,276,009 | B1 | 8/2001 | Schrougham | |
| 6,598,249 | B2 * | 7/2003 | Pajanacci et al. | 5/493 |
| 6,925,667 | B2 | 8/2005 | Cohen | |
| 6,971,129 | B2 | 12/2005 | Wootten | |
| 7,168,113 | B1 | 1/2007 | Olsen | |
| 7,207,078 | B1 | 4/2007 | Lakic | |
| 7,337,480 | B2 | 3/2008 | Borino | |
| D630,878 | S | 1/2011 | Kennett | |

(Continued)

FOREIGN PATENT DOCUMENTS

| | | | |
|---|---|---|---|
| GB | 2491625 | A | 12/2012 |
| WO | 2010081197 | A1 | 7/2010 |

*Primary Examiner* — Nicholas Polito
*Assistant Examiner* — Eric Kurilla
(74) *Attorney, Agent, or Firm* — Kilpatrick Townsend & Stockton LLP

(57) ABSTRACT

A wrap around bed skirt that can be secured in place without removing the mattress from the box springs. The bed skirt can include mitered corners that aid in retaining the bed skirt in place. The bed skirt may include a fabric drop with or without pleats or ruffles.

14 Claims, 8 Drawing Sheets

(56) References Cited

U.S. PATENT DOCUMENTS

| | | | | |
|---|---|---|---|---|
| D634,146 | S | 3/2011 | Kennett | |
| D634,958 | S | 3/2011 | Burgio-Timmany | |
| 8,393,024 | B2 | 3/2013 | Mitchell | |
| 8,650,681 | B2 | 2/2014 | Masoncup | |
| 2003/0028965 | A1* | 2/2003 | Wootten et al. | 5/493 |
| 2004/0226089 | A1 | 11/2004 | Miranda | |
| 2004/0231053 | A1* | 11/2004 | Masoncup | 5/493 |
| 2007/0017028 | A1* | 1/2007 | Myers | 5/497 |
| 2007/0271699 | A1* | 11/2007 | Sacchetti | 5/495 |
| 2008/0222806 | A1* | 9/2008 | Hart | 5/493 |
| 2011/0023234 | A1* | 2/2011 | Bolish et al. | 5/496 |
| 2011/0100067 | A1 | 5/2011 | Morgan | |
| 2011/0167561 | A1* | 7/2011 | Gatzke et al. | 5/493 |
| 2011/0308013 | A1 | 12/2011 | Kennett | |
| 2012/0042450 | A1* | 2/2012 | Hamilton et al. | 5/493 |
| 2012/0186015 | A1* | 7/2012 | Shattuck et al. | 5/485 |
| 2012/0198617 | A1* | 8/2012 | Hart | 5/493 |
| 2012/0233775 | A1 | 9/2012 | Flinn | |
| 2012/0297541 | A1 | 11/2012 | Brown | |
| 2014/0000029 | A1* | 1/2014 | Masoncup | 5/493 |

* cited by examiner

WRAP AROUND BED SKIRT

CROSS-REFERENCE TO RELATED APPLICATION

This application claims priority to U.S. Provisional Application No. 61/807,988 filed Apr. 3, 2013, the contents of which is hereby incorporated by reference.

FIELD OF THE INVENTION

The present invention relates to bed skirts, more specifically wrap around bed skirts that may be installed without removing the mattress from the box springs.

BACKGROUND

A bed skirt, also known in the art as a dust ruffle or valence, is placed between the mattress and the box springs of a bed. A bed skirt covers the sides of the box springs and any space under the bed that would otherwise be visible. Bed skirts also help prevent the collection of dust under a bed. Bed skirts are also used for aesthetic purposes to create a desired decorative look to a bed. Prior art methods of bed skirts include the use of elastic in the side panels for installation and securing of the bed skirt in place. The use of elastic often results in an ill-fitted bed skirt which may sag or droop.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Aspects of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Certain aspect of the present innovations relate to a wrap around bed skirt which may be installed without removing the mattress from the box springs. Aspects of the present invention have mitered corners, which are placed at the corners of the box springs to secure the bed skirt to the box springs. Aspects may also include a fabric band which aids in the installation of the bed skirt and a closure system comprising a hook and loop fastener, such as a Velcro fastener or other suitable closure systems. The hook and loop fastener allows the bed skirt to be fit snuggly to the box springs, which helps secure the bed skirt in place around the box springs. The weight of the mattress on the fabric band can also aid in maintaining the bed skirt in place.

Aspects of the present invention can include tailored bed skirts or ruffled or pleated bed skirts. In some aspects, a tailored bed skirt may include a fabric drop with or without pleats at various points along one or more sides. Additional aspects of the present invention can include a pleat in the middle of each side of a tailored bed skirt. Other aspects can include a ruffled or pleated bed skirt, where the entire length of each side of the bed skirt is ruffled or pleated. Aspects of the present invention can include bed skirts that can be secured in place without the use of elastic in the side panels that may cause sagging or drooping.

In some aspects of the invention the fabric drop at each corner of the bed skirt may be only be partially sewn shut, for example having a seam extending between about two inches and about three inches, while in other aspects the corner may be entirely sewn shut. In still yet other aspects, the fabric drop at each corner may not be sewn shut. In some aspects, at the head end of the bed skirt, there may be a cut out in the fabric drop, or the fabric drop may be shaped so as to expose a portion of the bed frame that is connected to a headboard.

BRIEF DESCRIPTION OF THE DRAWINGS

Illustrative aspects of the present invention are described in detail below with reference to the following drawing figures.

DETAILED DESCRIPTION

The subject matter of aspects of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Figure 1:
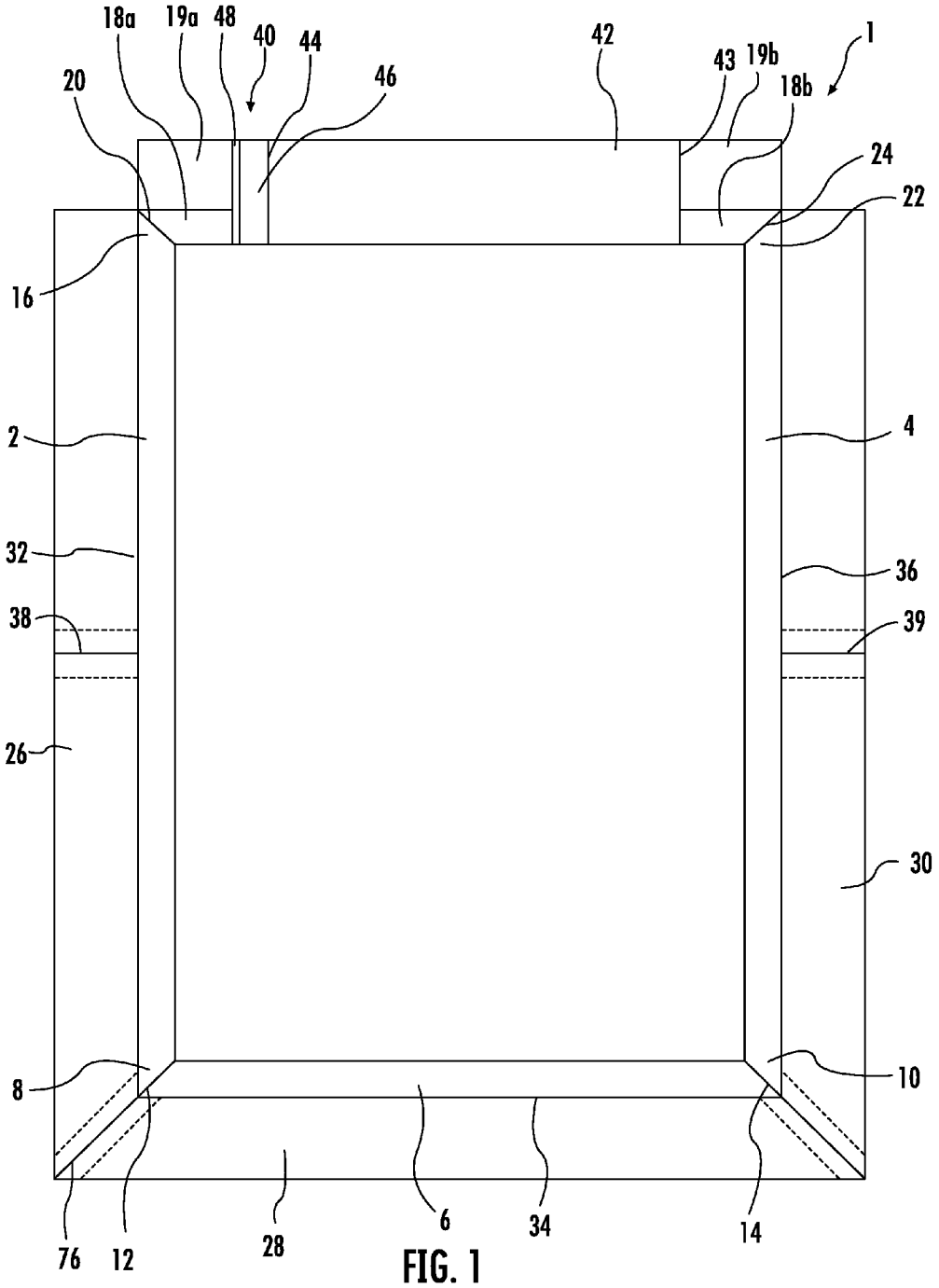
FIG. 1 illustrates a top view of one aspect of an exemplary bed skirt.

As shown in FIG. 1, one aspect of the present invention is a tailored bed skirt 1 having a generally rectangular shape comprising on the left side a first fabric band 2 and on the right side a second fabric band 4. The first and second fabric bands 2, 4 are generally parallel to one another and are connected by a bottom fabric band 6. A bottom end 8 of the first fabric band 2 is connected to the bottom fabric band 6 at a first mitered corner 12. A bottom end 10 of the second fabric band 4 is connected to the bottom fabric band 6 at a second mitered corner 14. A top end 16 of the first fabric band 2 is connected to a first top fabric band 18*a* at a third mitered corner 20 and a top end 22 of the second fabric band 4 is connected to a second top fabric band 18*b* at a fourth mitered corner 24. The first, second, and bottom fabric bands 2, 4, 6 can be approximately four inches wide, though other suitable widths may be used.

In some aspects when the bed skirt 1 is installed on a box springs, the first and second fabric bands 2, 4, and first and second top fabric bands 18*a*, 18*b*, and the bottom fabric band 6 each lay on the top surface of the box springs (not shown) between the box springs and the mattress (not shown). The first, second, third, and fourth mitered corners 12, 14, 20, 24 are configured to each receive a corner of the box springs and assist in retaining the bed skirt 1 in place. The mitered corners 12, 14, 20, 24 also aid in positioning a pleat at each of the corners of the bed skirt. A first fabric drop 26 extends from an outer edge 32 of the first fabric band 2. A bottom fabric drop 28 extends from an outer edge 34 of the bottom fabric band 6. A second fabric drop 30 extends from an outer edge 36 of the second fabric band 4. The first, bottom and second fabric drops 26, 28, 30 each extend approximately fourteen inches though any suitable drop length may be used. The first, bottom and second fabric drops 26, 28, 30 may be tailored, or may contain pleats, or other desirable design features such as ruffles.

Figure 8:
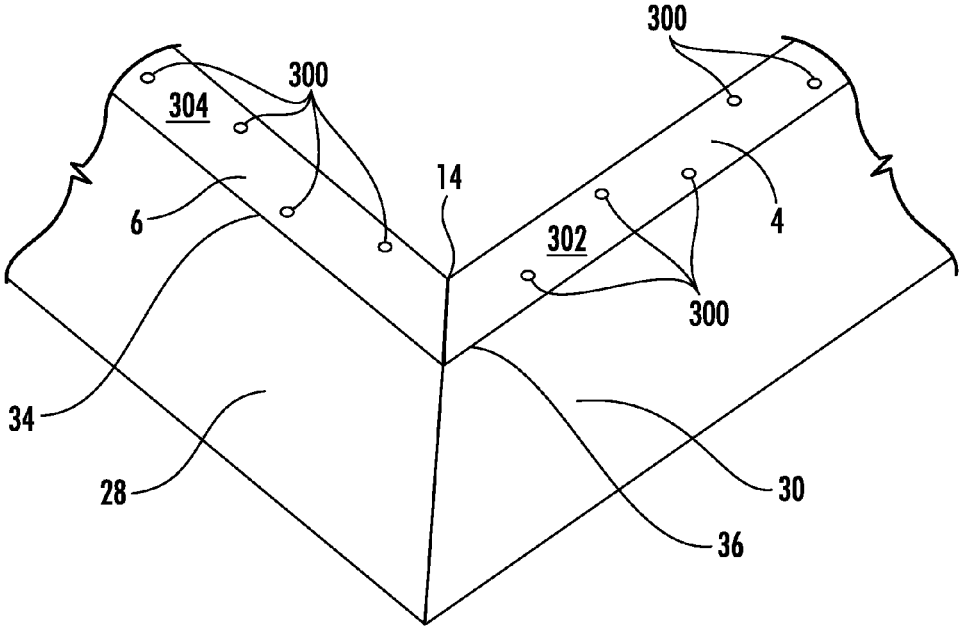
FIG. 8 illustrates a bottom view of one aspect of an exemplary bed skirt.

The first, second, and bottom fabric bands 2, 4, 6 can include a fabric that is substantially the same color as the first, second, and bottom fabric drops 26, 30, 28 though the fabric material may differ. For example, the first, second, and bottom fabric bands 2, 4, 6 can include a less expensive fabric material than the fabric material of the first, second, and bottom fabric drops 26, 30, 28. In another aspect, as shown in FIG. 8, one or more of the first, second, and bottom fabric bands 2, 4, 6, can include non-slip features 300 on the underside of the first, second, or bottom fabric bands 2, 4, 6. FIG. 8 depicts the non-slip features 300 on the underside 302 of the second fabric band 4 and the underside 304 of the bottom fabric band 6. The bottom fabric drop 28 extends from the outer edge 34 of the bottom fabric band. The second fabric drop 30 extends from the outer edge 36 of the second fabric band 4. The non-slip features 300 can include a material that increases the friction between the fabric band and the box springs. For example, the material of the non-slip features 300 can include silicone or can include a material with a high amount of surface roughness. The non-slip features 300 can aid in the position of the bed skirt between the box springs and the mattress. In one aspect, as shown in FIG. 8, the non-slip features 300 are silicone dots, in other aspects the non-slip features 300 can be other suitable shapes. In another aspect, the non-slip features 300 can comprise another suitable material in any suitable shape or size.

The aspect shown in FIG. 1 is a tailored bed skirt 1 with a first pleat 38 in the middle of the first fabric drop 26 and a second pleat 39 in the middle of the second fabric drop 30. The portion of the bed skirt 1 which is installed at the head of a box springs and mattress comprises a hook and loop closure system 40 that allows for adjustment of the fit of the bed skirt 1 around the box springs. Because box springs of the same size bed (e.g., twin) may still vary in size by manufacturer and brand, the hook and loop closure system 40 allows the bed skirt 1 to be custom fit to the box springs and can aid in retaining the bed skirt 1 in place regardless of slight variations in mattress size between brands. Other aspects may utilize other types of closure systems including, but not limited to button closures, ties, or hooks, snaps, any suitable type of fastener. In still yet other aspects, the closure system can include closures with alternative fastening points, for example, but not limited to, multiple strips of loops or multiple sets of buttons.

At the head end of the bed skirt 1 there is a generally rectangular piece of fabric referenced here as a closure band 42. The closure band 42 can be a different fabric than the fabric used for the fabric bands 2, 4, 6 and fabric drops 26, 28, 30. For example, the closure band 42 may be made a thinner fabric material, a less expensive fabric material, or a different type of fabric material (e.g. polyester fabric versus cotton fabric). In other aspects, various components of the bed skirt 1 can be manufactured from different types of fabrics. The closure band 42 is sewn together at an edge 43 with the second top fabric band 18*b* and a second top fabric drop 19*b*. The closure band 42 then extends across where the head of the box springs would be, and at an end 44 terminates with a loop element 46 of a hook and loop closure 40. The first top fabric band 18*a* and a first top fabric drop 19*a* both extend inwardly from the mitered corner 20 and terminate with a hook element 48. The hook element 48 corresponds to the loop element 46 on the closure band 42. The loop element 46 can be approximately two times wider than the hook element 48. For example, the hook element 48 may extend approximately one to two inches while the loop element 46 may extend approximately two to four inches.

Given the width of the area of loop element 46 and the hook element 48, the hook element 48 can attached at various points along the width of the loop element 46. This variable area of attachment of the hook element 48 and the loop element 46 can allow adjustments to the circumference of the bed skirt 1. In some aspects the first top fabric drop 19*a* and second top fabric drop 19*b* extend inwardly approximately six inches and extend downwardly approximately six inches, though other suitable lengths and widths may be used. The length of the first top fabric drop 19*a* and/or the second top fabric drop 19*b* can be shorter than the length of the fabric drops 26, 28, 30 to allow access to the location on a bed frame that allows for connection to a headboard.

Figure 2:
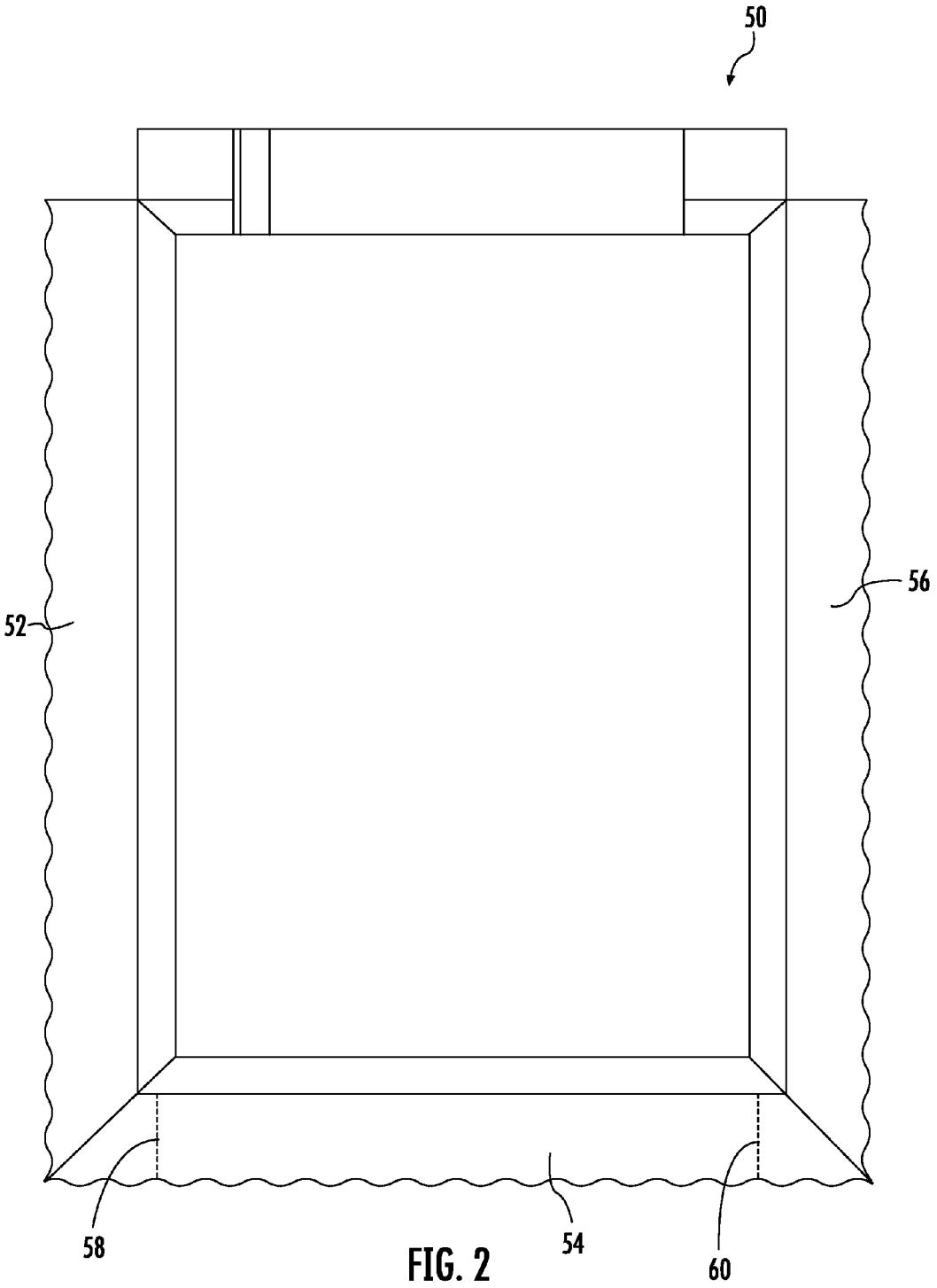
FIG. 2 illustrates a top view of another aspect of an exemplary bed skirt.

The bed skirt 50 shown in FIG. 2 depicts a bed skirt having a ruffled first fabric drop 52, a ruffled bottom fabric drop 54, and a ruffled second fabric drop 56. In addition, as shown in the aspect of the invention depicted in FIG. 2 the ruffled first fabric drop 52 can wrap under a portion of the ruffled bottom fabric drop 54 to the point 58. Similarly, the ruffled second fabric drop 56 can wrap under a portion of the ruffled bottom fabric drop 54 to the point 60.

Figure 3:
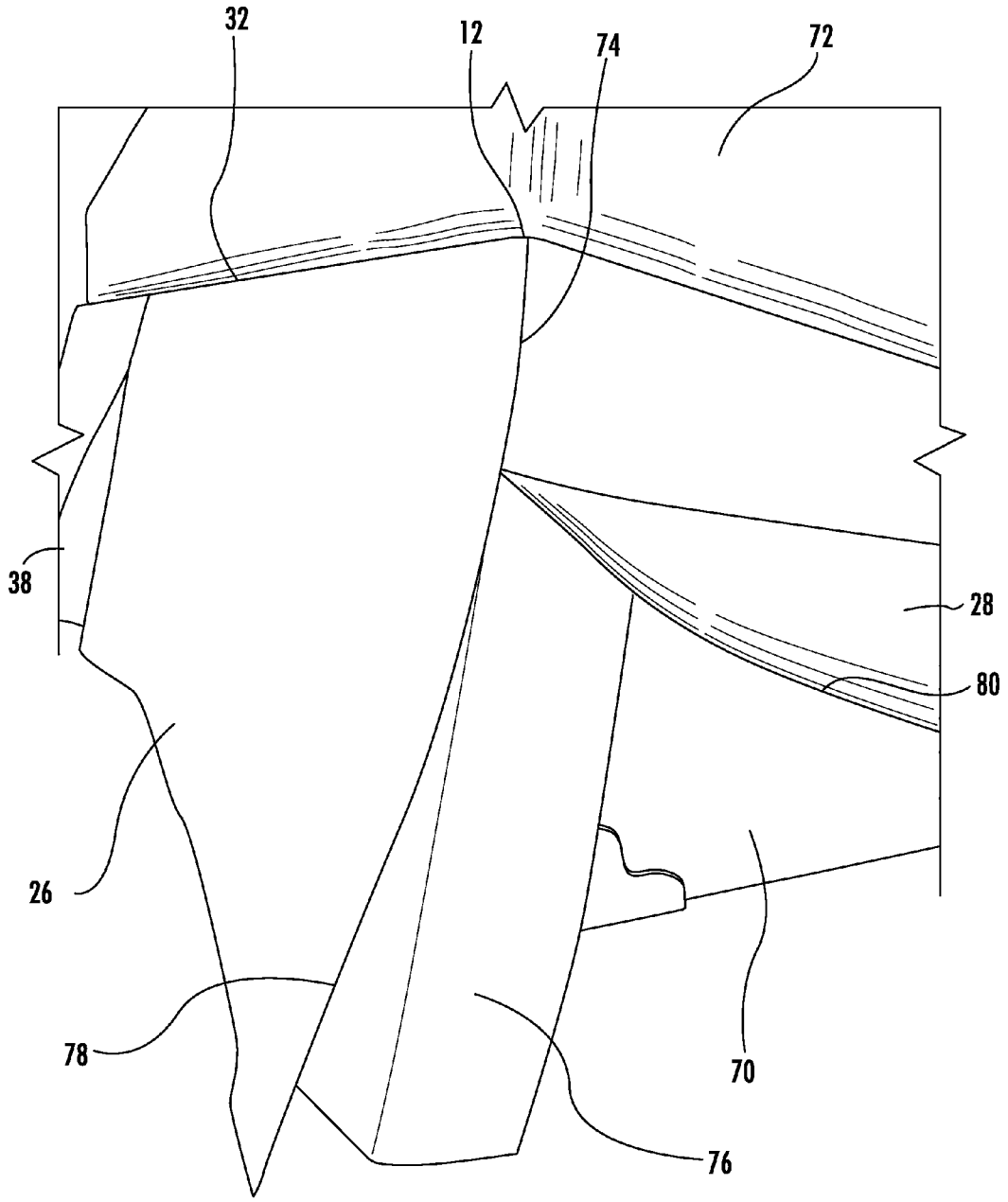
FIG. 3 illustrates a side view of a portion of the exemplary bed skirt depicted in FIG. 1.

FIG. 3 depicts a side view of a portion of the exemplary bed skirt 1 depicted in FIG. 1 when the bed skirt 1 is installed between a box springs 70 and a mattress 72. In the aspect depicted in FIG. 3, the first fabric drop 26 extends from the outer edge 32 of the first fabric band 2 (not shown in FIG. 3) downwards. A particular mattress size (e.g. twin or queen) may still vary by a few inches vary between brands and styles. Given the bed skirt 1 is adjustable to fit a variety brands and/or styles of mattresses, in some aspects the first fabric band 2 and/or the first fabric drop 26 may be positioned differently than shown in FIG. 3. For example, the first fabric band 2 may be positioned more towards the center of the box springs 70 and the mattress 72.

In the aspect depicted in FIG. 3, the first fabric drop 26 and the bottom fabric drop 28 are partially sewn together along a seam 74 extending from the first mitered corner 12 downwardly between approximately two inches and approximately three inches. As depicted in FIG. 3, the bottom fabric drop 28 is partially lifted to show the pleat 76 folds under fabric drop 26 approximately two inches, then folds out approximately two inches, and finally extends under bottom fabric drop 28 approximately two inches, though other suitable widths of pleats may be used. The pleat 76 covers the portion of the box springs 70 that would otherwise be visible between the edge 78 of fabric drop 26 and the edge 80 of bottom drop 28 below the seam 74. In other words, the pleat 76 is an extension of the fabric drop 26 that is folded under itself and wraps around the corner of the box springs 70, extending under the bottom fabric drop 28 approximately two inches.

Figure 4:
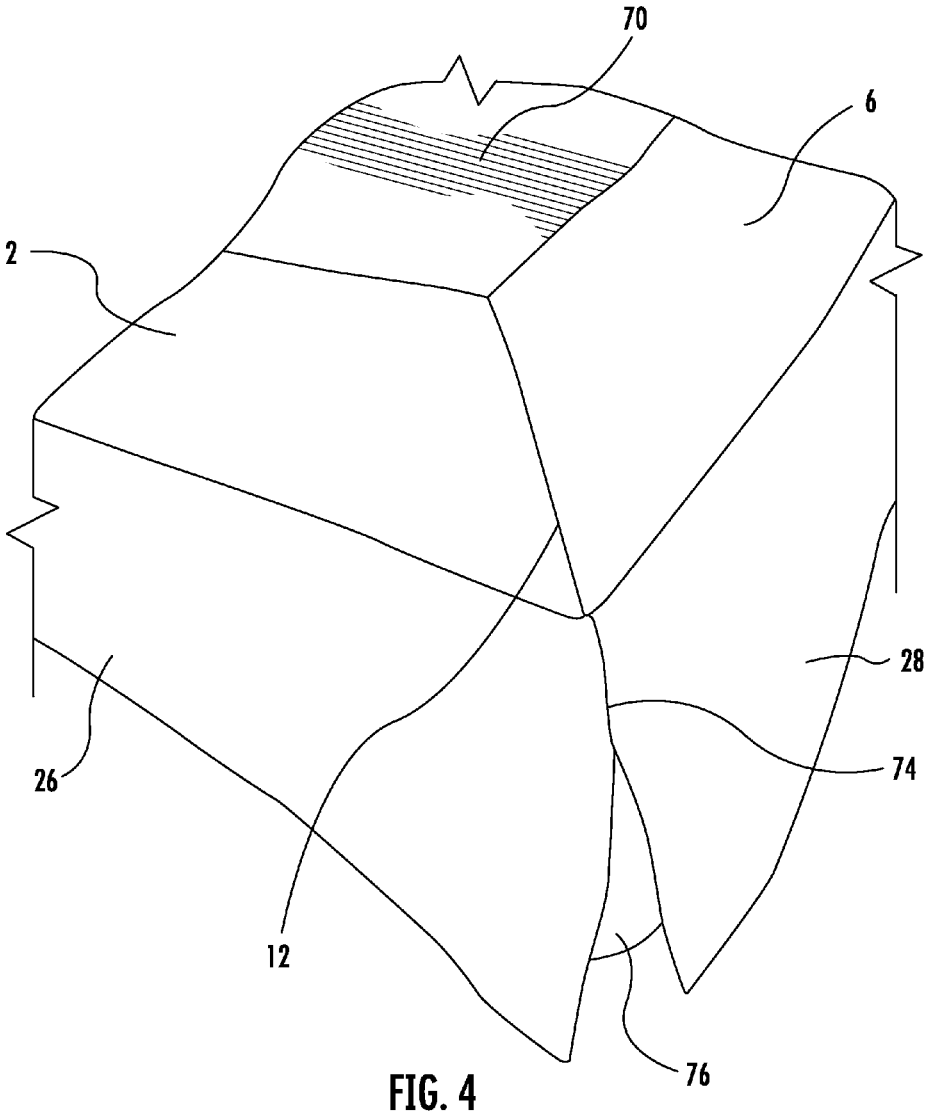
FIG. 4 is a top-side view of a portion of the exemplary bed skirt depicted in FIG. 1.

FIG. 4 depicts a top-side view of the exemplary bed skirt 1 depicted in FIG. 1 when installed on top of a box springs 70 without a mattress placed thereon. As depicted in FIG. 4, the first fabric band 2 and the bottom fabric band 6 are sewn together at the first mitered corner 12. The first mitered corner 12 receives a corner of the box springs 70 and aids in securing the bed skirt 1 in place on the box springs. In the aspect shown in FIG. 4, the first fabric drop 26 and the bottom fabric drop 28 are sewn together along the seam 74 extending from mitered corner 12 downward approximately two to approximately three inches. In other aspects the seam 74 may extend the entire length of the fabric drops 26, 28. In still yet other aspects the first fabric drop 26 and the bottom fabric drop 28 may not be sewn together at all. In the aspect depicted in FIG. 4, a pleat 76 is created by the first fabric drop 26, whereby the pleat 76 folds partially under the first fabric drop 26 and then folds back out and extends partially under the bottom fabric drop 34. In the aspect shown in FIG. 4 the pleat 76 extends approximately two inches under the bottom fabric drop 28, though any suitable seam length may be used.

Figure 5:
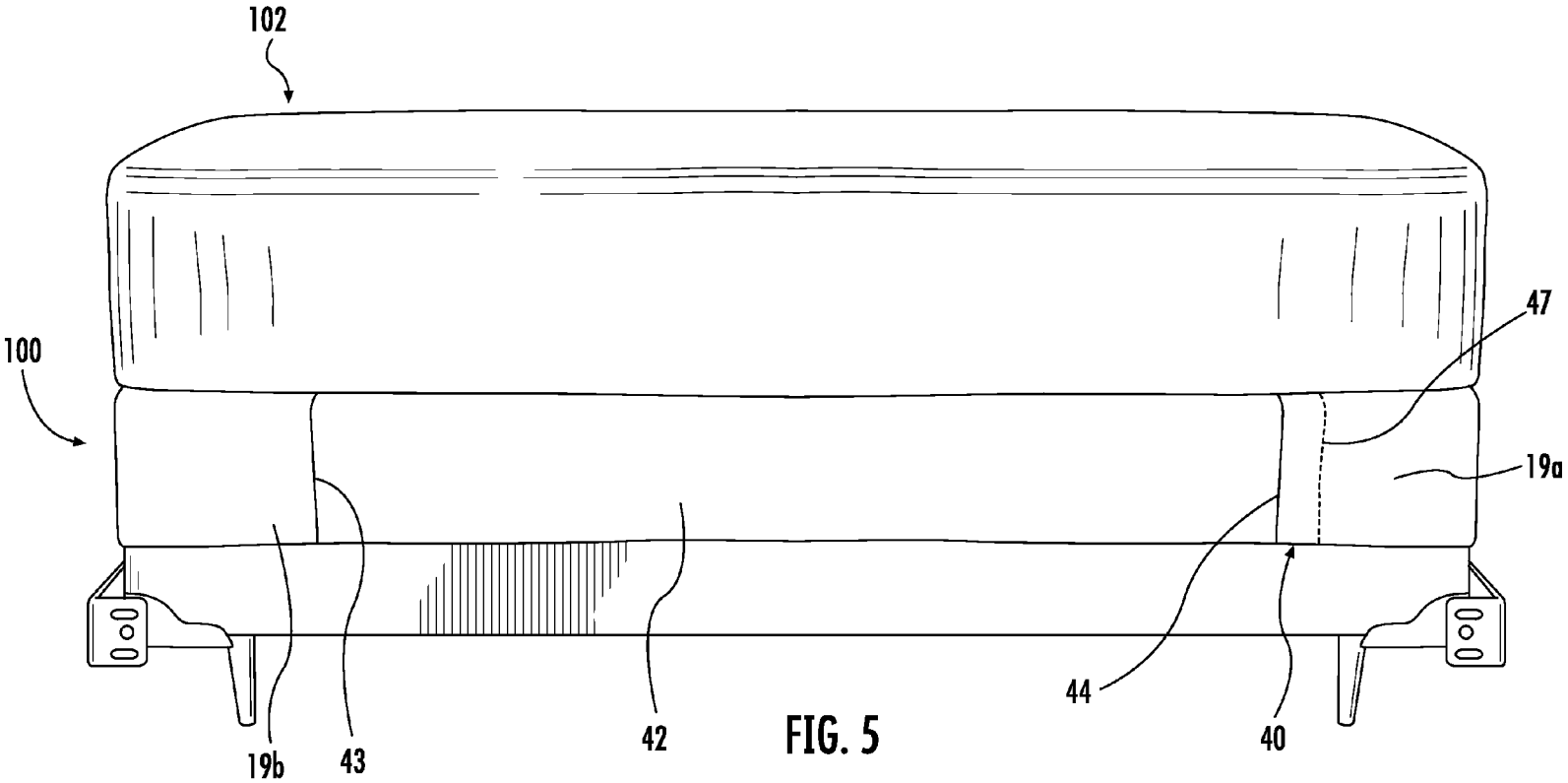
FIG. 5 is a side view of a portion of the exemplary bed skirt depicted in FIG. 1.

FIG. 5 depicts a side-view of the head area of the bed skirt 1 depicted in FIG. 1 installed between a box springs 100 and mattress 102. As shown in FIG. 5, the closure band 42 is sewn together with the second top fabric band 18*b* (not shown in FIG. 5) and the second top fabric drop 19*b* along the edge 43. The loop element 46 (not shown in FIG. 5) of a hook and loop closure 40 extends from the end 44 of the closure band 42 approximately two to four inches. The hook element 48 (not visible in FIG. 5) of the hook and loop closure 40 extends from an edge 47 of the first top fabric drop 19*a* and first top fabric band 18*a* approximately one to two inches. In some aspects the hook element 48 (not visible in FIG. 5) may only extend from the edge of the first top fabric drop 19*a*.

As depicted in FIG. 5 the bed skirt 1 is secured at the head of the box springs 100 by the hook and loop closure 40. As depicted in FIG. 5, first top fabric drops 19*a* and 19*b* terminate above the bedframe. The length of the first top fabric drops 19*a*, 19*b* depicted in FIG. 5 can allow direct access to connect the bedframe to a headboard. In other aspects, the first top fabric drops 19*a*, 19*b* can extend to any suitable length, for example the first top fabric drops 19*a*, 19*b* can extend below the bedframe.

Figure 6:
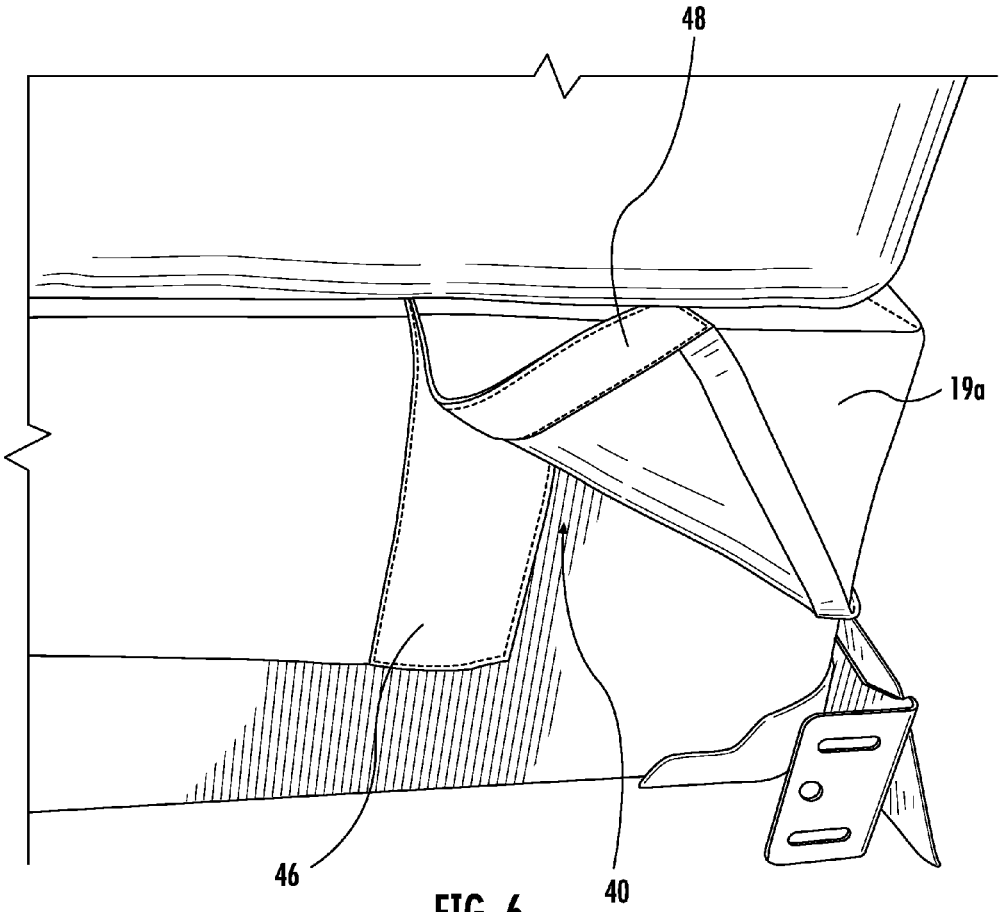
FIG. 6 is a side view of a portion of the exemplary bed skirt depicted in FIG. 1.

FIG. 6 depicts a side view of the hook and loop closure 40 of bed skirt 1 depicted in FIG. 1. In FIG. 6 the first top fabric drop 19*a* and the hook element 48 are lifted away from the loop element 46 to expose the hook element 48 and loop element 46 to view. As shown in FIG. 6, the ration between the width of the loop element 46 and the hook element 48 allows for the hook element 48 to be secured at various locations along the width of the loop element 46. The various points of attachment possible between the hook element 48 and loop element 46 can allow the adjustment of the position of the bed skirt 1 around the box springs.

Figure 7:
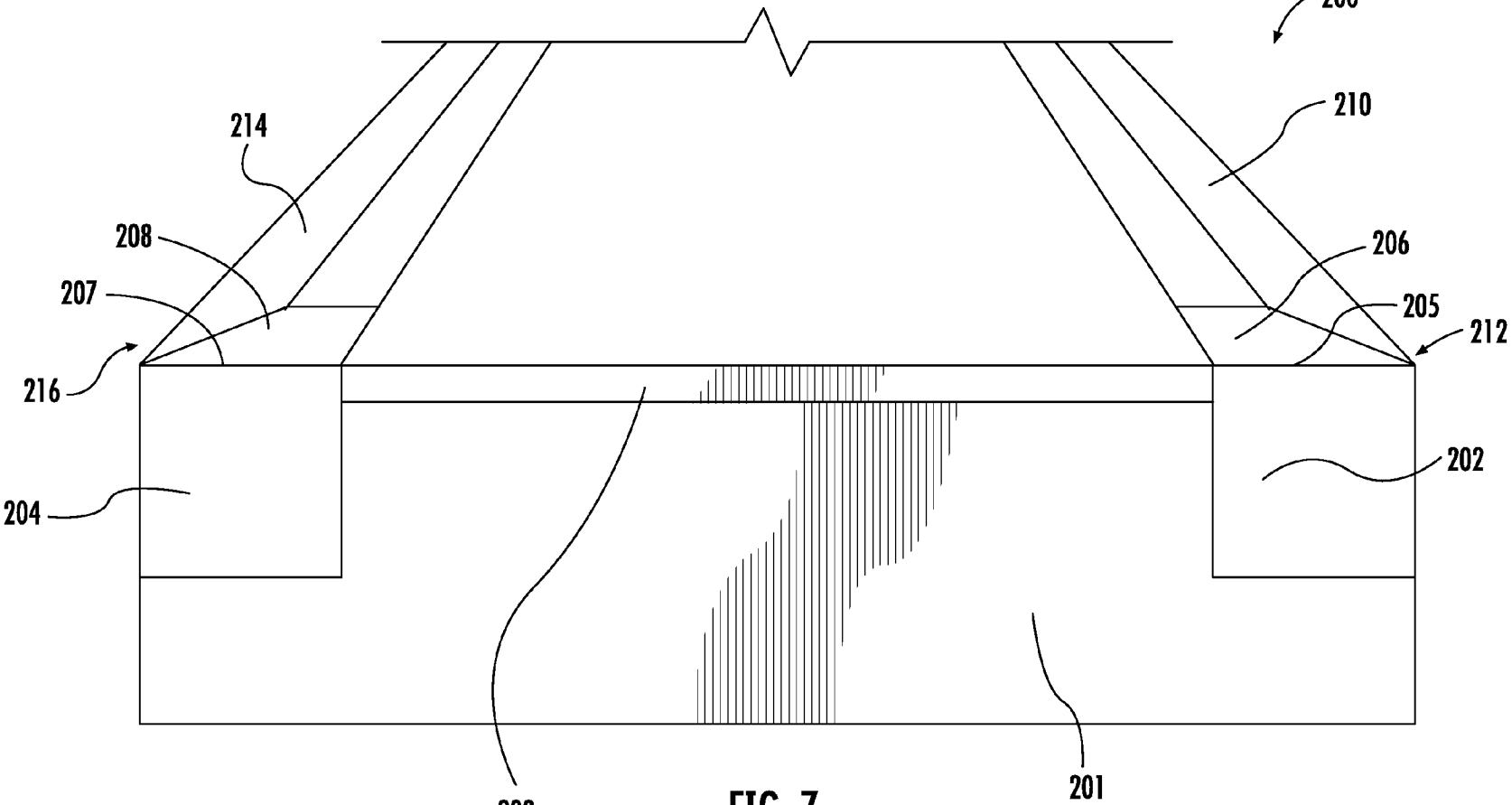
FIG. 7 is a side view of a portion of another aspect of an exemplary bed skirt.

FIG. 7 depicts an alternative aspect of the bed skirt 200 of the present invention. The bed skirt 200 is positioned on a box springs 201. The aspect depicted in FIG. 7 includes an elastic band 203 that extends from a first top fabric drop 202 to a second top fabric drop 204. The first top fabric drop 202 extends from an edge of a first top fabric band 206. The second top fabric drop 204 extends from an edge of a second top fabric band 208. The elastic band 200 is sewn at a first end to the first top fabric drop 202 and at a second end to the second top fabric drop 204. The first end of the elastic band 203 is positioned proximate to the seam 205 between the first top fabric band 206 and the first fabric drop 202. The second end of the elastic band 203 is positioned proximate to the seam 207 between the second top fabric band 208 and the second top fabric drop 204. In other aspects the elastic band 203 may be sewn in other locations relative to the top fabric bands 206, 108 and first and second top fabric drops 202, 204. The elastic nature of the elastic band 203 can aid in retaining the bed skirt 200 around a box springs of a specific bed size (e.g. twin, queen, king) given the variable sizes of box springs of the same bed size manufactured by different brands. The length of the elastic band 203 can vary based on the bed size the bed skirt 200 is designed for. For example, the elastic band 203 can be between 24 and 62 inches long depending on the bed size. The elastic band can be between approximately ¼ inch to approximately 3 inches wide, though any suitable width may be used. The elastic band can comprise a woven elastic, including, for example, polyester, spandex, nylon, rubber components, or other suitable materials.

As shown in FIG. 7, the first top fabric band 206 is sewn together with a left fabric band 210 at a first mitered corner 212. The second top fabric band 208 is sewn together with a right fabric band 214 at a second mitered corner 216. The mitered corners 214, 216 can also be retained in their position on the respective corners of box spring by the tension in the elastic band 200.

Different arrangements of the components depicted in the drawings or described above, as well as components and steps not shown or described are possible. Similarly, some features and subcombinations are useful and may be employed without reference to other features and subcombinations. Aspects of the invention have been described for illustrative and not restrictive purposes, and alternative aspects will become apparent to readers of this patent. Accordingly, the present invention is not limited to the aspects described above or depicted in the drawings, and various aspects and modifications can be made without departing from the scope of the claims below.

That which is claimed is:

1. A wrap around bed skirt comprising:

a left fabric band;

a right fabric band;

a bottom fabric band;

a first top fabric band;

a second top fabric band;

wherein a first end of the left fabric band is connected to a first end of the bottom fabric band at a first mitered corner and a first end of the right fabric band is connected to a second end of the bottom fabric band at a second mitered corner, wherein a second end of the left fabric band is connected to a first end of the first top fabric band at a third mitered corner and a second end of the right fabric band is connected to a first end of the second top fabric band at a fourth mitered corner, and a left skirt portion connected to an outer edge of the left fabric band;

a right skirt portion connected to an outer edge of the right fabric band;

a bottom skirt portion connected to an outer edge of the bottom fabric band;

a first top fabric drop connected to an outer edge of the first top fabric band;

a second top fabric drop connected to an outer edge of the second top fabric band;

a first end of an elastic band connected to at least a portion of the first top fabric drop;

a second end of the elastic band connected to at least a portion of the second top fabric drop;

a first corner pleat at a bottom end of the left skirt portion; and a second corner pleat at a bottom end of the right skirt portion, wherein the elastic band is the only elastic band included in the bed skirt and the elastic band has a length that is less than a length of the bottom fabric band, and wherein each of the first and second corner pleats extend at least partially under the bottom skirt portion.

2. The bed skirt of claim 1, further comprising a seam connecting the left skirt portion and the bottom skirt portion that extends from an outer edge of the first mitered corner.

3. The bed skirt of claim 1, wherein a width of the left fabric band from an inner edge of the left fabric band to the outer edge of the left fabric band is less than half a width of the left skirt portion from the outer edge of the left fabric band to an outer edge of the left skirt portion.

4. The bed skirt of claim 1, further comprising at least one side pleat on each of the left skirt portion and the right skirt portion.

5. The bed skirt of claim 1, wherein a fabric comprising the left fabric band is substantially the same color as a fabric comprising the left skirt portion.

6. The bed skirt of claim 1, wherein a fabric comprising the left fabric band is a different material than a fabric comprising the left skirt portion.

7. The bed skirt of claim 1, wherein the left skirt portion, the right skirt portion, and the bottom skirt portion each have a length that is greater than a length of the first top fabric drop and the second top fabric drop.

8. The bed skirt of claim 1, wherein an underside of at least one of the left fabric band, the right fabric band, the bottom fabric band, the first top fabric band, or the second top fabric band includes at least one non-slip feature.

9. The bed skirt of claim 8, wherein the at least one non-slip feature includes silicone.

10. The bed skirt of claim 1, wherein the elastic band is approximately one inch wide.

11. A wrap around bed skirt comprising:

a left fabric band;

a right fabric band;

a bottom fabric band;

a first top fabric band;

a second top fabric band;

wherein at least one of an underside of the left fabric band or an underside of the right fabric band includes at least one non-slip feature, wherein a first end of the left fabric band is connected to a first end of the bottom fabric band at a first mitered corner and a first end of the right fabric band is connected to a second end of the bottom fabric band at a second mitered corner, wherein a second end of the left fabric band is connected to a first end of the first top fabric band at a third mitered corner and a second end of the right fabric band is connected to a first end of the second top fabric band at a fourth mitered corner, and a left skirt portion connected to an outer edge of the left fabric band;

a right skirt portion connected to an outer edge of the right fabric band;

a bottom skirt portion connected to an outer edge of the bottom fabric band;

a first top fabric drop connected to an outer edge of the first top fabric band;

a second top fabric drop connected to an outer edge of the second top fabric band;

a first end of a single elastic band connected to at least a portion of the first top fabric drop;

a second end of the single elastic band connected to at least a portion of the second top fabric drop;

a first corner pleat at a bottom end of the left skirt portion; and a second corner pleat at a bottom end of the right skirt portion, wherein the single elastic band is the only elastic band included in the bed skirt and the single elastic band has a length that is less than a length of the bottom fabric band, and wherein each of the first and second corner pleats extend at least partially under the bottom skirt portion.

12. The wrap around bed skirt of claim 11, wherein the at least one non-slip feature includes silicone.

13. The wrap around bed skirt of claim 11, wherein the at least one non-slip feature is a shape selected from the group comprising a circle, a square, and a triangle.

14. The wrap around bed skirt of claim 11, wherein the elastic band is approximately one inch wide.

* * * * *